United States Patent [19]

Goossens et al.

[11] Patent Number: 4,702,855

[45] Date of Patent: Oct. 27, 1987

[54] ELECTROVISCOUS FLUIDS

[75] Inventors: John Goossens; Günter Oppermann, both of Leverkusen; Wolfgang Grape, Cologne, all of Fed. Rep. of Germany

[73] Assignee: Bayer Aktiengesellschaft, Leverkusen, Fed. Rep. of Germany

[21] Appl. No.: 914,211

[22] Filed: Oct. 1, 1986

[30] Foreign Application Priority Data

Oct. 17, 1985 [DE] Fed. Rep. of Germany ..... 3536934

[51] Int. Cl.[4] ..... C09K 3/00

[52] U.S. Cl. ..... 252/75; 252/74; 252/78.3; 252/573

[58] Field of Search ..... 252/74, 75, 78.3, 573

[56] References Cited

U.S. PATENT DOCUMENTS 3,047,507 7/1962 Winslow ..... 252/74

4,645,614 2/1987 Goossens et al. ..... 252/75

FOREIGN PATENT DOCUMENTS 53-17585 2/1978 Japan .

*Primary Examiner*—Robert A. Wax

*Attorney, Agent, or Firm*—Sprung Horn Kramer & Woods

[57] ABSTRACT

Electroviscous fluids are disclosed which are composed of aluminum silicates particles in an electrically non-conductive liquid and a suitable dispersing agent. The atomic ratio of Al/Si on the surface of the aluminum silicate lies within the range of 0.15 to 0.80.

7 Claims, 1 Drawing Figure

ELECTROVISCOUS FLUIDS

Figure 1:
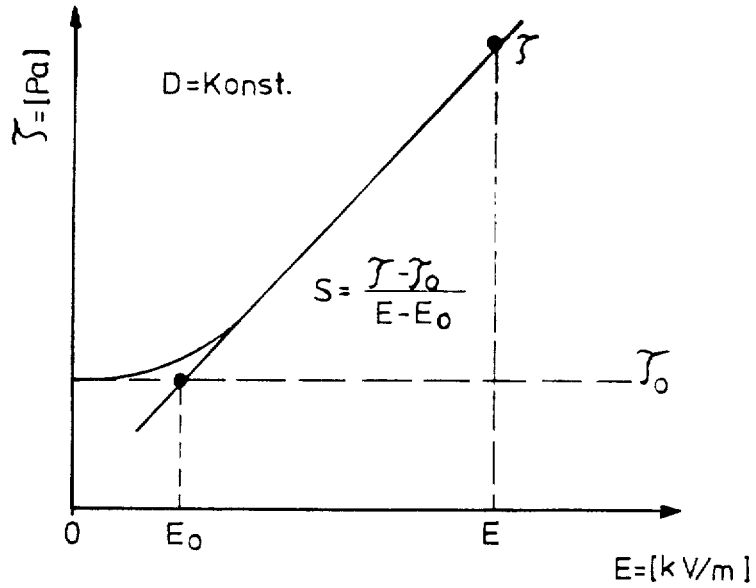

This invention is directed to electroviscous suspensions containing more than 25% by weight of an aluminum silicate with a water content of 1 to 25% by weight as a disperse phase and an electrically non-conductive hydrophobic liquid as a liquid phase and a dispersing agent.

Electroviscous fluids (EVF) are dispersions of finely divided hydrophilic solids in hydrophobic, electrically non-conductive oils the viscosity of which can be rapidly and reversibly increased from the liquid to the plastic or solid state under the influence of a sufficiently powerful electric field. Both electric direct current fields and electric alternating current fields may be used for altering the viscosity. The currents flowing through the EVF in the process are extremely low. EVFs may therefore be used wherever the transmission of powerful forces is required to be controlled with only low electric power, e.g. in clutches, hydraulic valves, shock absorbers, vibrators or devices for positioning and holding workpieces in position.

The requirements arising from practical considerations are generally that the EVF should be liquid and chemically stable within a temperature range of from about −50° C. to 150° C. and should produce a sufficient electroviscous effect at least over a temperature range of from −30° C. to 110° C. It is also necessary to ensure that the EVF remains stable over a prolonged period, i.e. it should not undergo phase separation and in particular there should be no formation of any sediment which is not readily redispersible. Furthermore, if the EVF comes into contact with elastomeric materials, it should not attack them or cause them to swell.

A variety of substances has already been proposed as a disperse phase for EVFs in 1962 in U.S. Pat. No. 3,047,507, in which silica gel was mentioned as a preferred substance. EVFs based on silica gel dispersions in nonconductive oils have also been described in British Pat. No. 1,076,754, in which the water content of the silica gel particles and the form in which this water is bound are regarded as particularly critical in determining the electroreactivity of the EVF. In the more recent literature, EVFs based on various types of ionic exchanger particles are described (see e.g. German Offenlegungsschrift No. 2 530 694 and British Pat. No. 1 570 234). It has already been pointed out in U.S. Pat. No. 3,047,507 that the electroviscous effects of these EVFs are comparable to those manifested by EVFs based on silica gel particles. It is said that the particle size of the ion-exchanger particles should be in the range of 1 to 50 μm. This has the result that the particles settle and in order to prevent settling of the relatively large particles it is customary to adapt the density of the liquid phase to the density of the disperse phase. This adaptation of density is, however, dependent upon the temperature and therefore not suitable for practical purposes.

It is an object of the present invention to provide EVFs with a substantially higher electroreactivity which is preferably maintained at high temperatures, and in addition a low electric conductivity.

Using as a starting material an EVF containing an aluminum silicate dispersed in an electrically nonconductive liquid by means of a suitable dispersing agent, this problem is solved according to the invention by ensuring that the atomic ratio of Al/Si on the surface of the aluminum silicate lies within the range of 0.15 to 0.80, preferably from 0.2 to 0.75. The Al/Si atomic ratio on the surface of the particles may deviate considerably from the overall volumetric composition.

According to a preferred embodiment, the dispersing agents used are aminofunctional or hydroxyfunctional or acetoxyfunctional or alkoxyfunctional polysiloxanes having a molecular weight above 800. These functional polysiloxanes are added at a concentation of 1 to 30% by weight, preferably 5 to 20% by weight, based on the aqueous aluminum silicate particles.

The aminofunctional polysiloxanes used as dispersing agents preferably correspond to the following general formula:

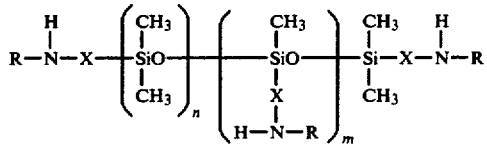

wherein $10 < n < 1000$, $m = 0$ to 5,

R = H or alkyl with 1 to 8 atoms and

X = a divalent hydrocarbon radical consisting of C, H and optionally O and/or N.

The amino groups are linked to the basic silicone molecule either through a SiC linkage or through a SiOC linkage. If a SiC linkage is desired, then X stands for a divalent hydrocarbon group having 1 to 6, preferably 1 to 3 carbon atoms. Particularly preferred aminofunctional groups are the aminomethyl group and the γ-aminopropyl group. The divalent radical X may contain N in addition to C and H. Thus X-NHR may denote, for example, the group $CH_2—CH_2—CH_2—NH—CH_2—CH_2—NH_2$. If a SiOC linkage is desired, then the aminofunctional group

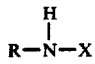

is an aminoalkoxy group. A secondary SiOC linkage is preferred for reasons of resistance to hydrolysis. The 1-amino-2-propoxy group

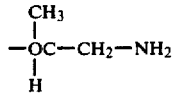

and the 1-amino-3-butoxy group

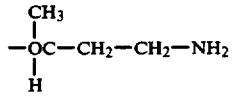

are particularly suitable.

Instead of using aminofunctional polysiloxanes, silicon functional polysiloxanes corresponding to the general formula

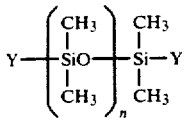

may be used as dispersing agents. In these formulae, $10 < n < 1000$, and

Y stands for a hydrolyzable group, preferably a hydroxyl, alkoxy or carboxy group.

The above mentioned functional polysiloxanes which may be used as dispersing agents preferably contain 20 to 300 dimethylsiloxane units. These enable dispersions with a high solids content to be obtained without too high an intrinsic viscosity.

The invention provides the following advantages:

EVFs containing aluminum silicates surprisingly have much higher electroreactivities than those containing silica gel or aluminum oxide.

In addition they are highly compatible with elastomeric materials, in particular rubber, resistant to settling and physiologically inert (not toxic). In addition, they are resistant to heat and cold over an exceptionally wide temperature range and their viscosity depends only slightly on the pressure. Furthermore, the electroviscous suspensions according to the invention have advantageous dielectric constants and high dielectric strengths, which depend only slightly on the temperature and frequency.

Furthermore, it has been found, in particular in the case of those EVFs according to the invention which contain a silicone oil as a liquid phase and one of the functional polysiloxanes according to the invention as a dispersing agent, that the electroreactivity is very well maintained even at high temperatures.

Another advantage is that the EVFs can be prepared relatively easy and therefore inexpensively and from ordinary commercial products.

The invention is described in more detail below with reference to Examples illustrated with the aid of diagrams and Tables, in which FIG. 1 shows the shear stress determined for the EVF as a function of the electric field strength at constant shear velocity, Table 1 summarizes the data of the disperse phase and Table 2 gives the characteristic data of the EVFs according to the invention in comparison with the prior art.

The process steps for preparing the EVFs, the chemical method of preparation of the dispersing agents, the measuring techniques required for controlling the desired physical properties, and typical exemplary embodiments of the EVFs according to the invention are given.

Commercial aluminum silicates may be used for the preparation of EVFs. The moisture content of the aluminum silicate may be increased or lowered as required.

To prepare the dispersions, the dispersion medium and either all or part of the dispersing agent are introduced into the reaction vessel and the aluminum silicate is introduced into the dispersing medium with constant stirring. The aluminum silicate may be added rapidly at the beginning but towards the end is added slowly as the viscosity increases. If only a proportion of the dispersing agent is introduced into the reaction vessel at the beginning, then the remainder of the dispersing agent is subsequently added together with the aluminum silicate. Which of these methods is used for adding the dispersing agent is not critical for the final properties of the EVF, nor is the precise method of mixing. Thus, for example, simple stirrer devices, ball mills or ultrasound may be used for dispersion, but if the components are mixed vigorously the dispersions can generally be prepared more rapidly and are obtained in a more finely divided form.

The qunatity of dispersing agent required depends to a large extent on the specific surface area of the aluminum silicate used. As a general guide, about 1 to 4 $mg/m^2$ are required but the absolute quantity required also depends on the nature of the aluminum silicate used and of the dispersing agent.

The aluminum silicates used may be either amorphous or crystalline, e.g. precipitated aluminum silicate or zeolite. The Al/Si atomic ratio on the surface of the aluminum silicate particles, which determines the degree of electroreactivity, was determined by ESCA (Electron spectroscopy for chemical analysis). The aluminum silicates need not be pure and may well contain up to 20% by weight of $Fe_2O_3$, $Tio_2$, CaO, MgO, $Na_2O$ and $K_2O$. They also may contain a few percent by weight of $SO_3$ and Cl. Furthermore, the surface examined by ESCA may contain up to 25 atomic percent of carbon. The ignition loss, i.e. the weight loss at 1000° C., generally varies from 10 to 15% by weight in the case of amorphous aluminum silicates. On average about 6% by weight of this loss is due to moisture and is equal to the weight loss determined when the substance is dried at 105° C. The specific surface area of the amorphous aluminum silicates, determined by the BET method, is generally in the region of 20 to 200 $m^2/g$. The crystalline aluminum silicates may either be present in the form of salts, the monovalent salts being preferred, or in the $H^+$ form. The water content determined by drying at 500° C. is about 1 to 25% by weight and is preferably about 5 to 15% by weight.

The dispersion media used for the aluminum silicate particles are preferably silicone oils such as polydimethylsiloxanes or polymeric methyl phenyl siloxanes. Liquid hydrocarbons may also be used for this purpose, e.g. paraffins, olefins or aromatic hydrocarbons. Other substances which may be used include, for example, fluorinated hydrocarbons, polyoxyalkylenes and fluorinated polyoxyalkylenes. The dispersion media are preferably adjusted to have a solidification point below −30° C. and a boiling point above 150° C. The viscosity of the oils at room temperature is in the region of 3 to 300 $mm^2/s$. Low viscosity oils are generally preferred (3 to 20 $mm^2/s$) because the EVF obtained then has a lower intrinsic viscosity so that marked changes in viscosity can be obtained by the electroviscous effect.

Soluble surface-active agents may be used as dispersing agents in the dispersing medium, e.g. compounds derived from amines, imidazolines, oxazolines, alcohols, glycol or sorbitol. Soluble polymers may also be used in the dispersing medium, e.g. polymers containing 0.1 to 10% by weight of N and/or OH and 25 to 83% by weight of $C_4$–$C_{24}$ alkyl groups and having a molecular weight in the range of $5 \cdot 10^3$ to $10^6$. The compounds containing N and OH in these polymers may be, for example, amines, amides, imides, nitriles or 5- to 6-membered heterocyclic ring compounds containing nitrogen, or they may be alcohols, and the $C_4$–$C_{24}$ alkyl groups may be esters of acrylic or methacrylic acid. The following are specific examples of the above-mentioned compounds containing N and OH: N,N-dimethyl-aminoethylmethacrylate, tert.-butylacrylamide, maleic imide, acrylonitrile, N-vinylpyrrolidone, vinylpyridine and 2-hydroxyethylmethacrylate. The above mentioned polymeric dispersing agents generally have the advantage over low molecular weight surface active agents that the dispersions obtained with their aid are more resistant to settling and the electroreactivity is less dependent upon the frequency.

The functional polysiloxanes according to the invention are particularly preferred dispersing agents for the preparation of EVFs in which the aluminum silicate is dispersed in a silicone oil. The basic principle of preparing such polysiloxanes is well known to the person skilled in the art.

The method of preparation of the amine-modified polysiloxanes used as dispersing agents varies according to the type of linkage desired. Compounds of the type

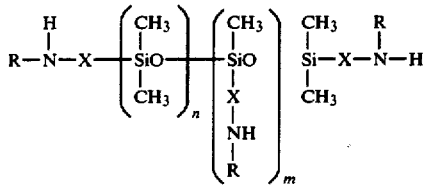

in which n and m have the meanings indicated above and $X=CH_2$ are prepared from the corresponding halogen derivatives (Cl or Br) and the corresponding amines according to the following reaction scheme:

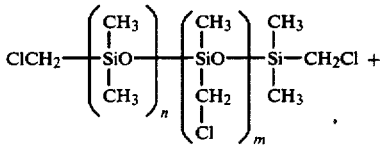

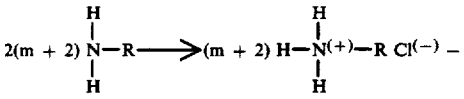

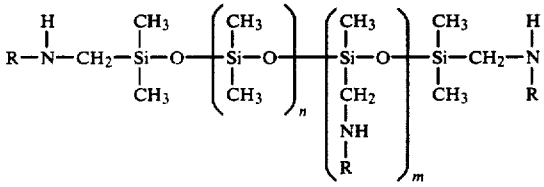

The chlorine-containing compound is prepared by cohydrolysis of the desired quantities of $ClCH_2(CH_3)_2SiCl$, $ClCH_2(CH_3)SiCl_2$ and $(CH_3)_2SiCl_2$. Br, may of course, be used instead of Cl.

Compounds of the above mentioned type in which X is an alkyl group with 2 to 6 carbon atoms may be prepared, for example, by platinum catalyzed addition of a suitable olefin to compounds containing SiH. Thus, for example, allyl chloride reacts with a silicone oil corresponding to the formula

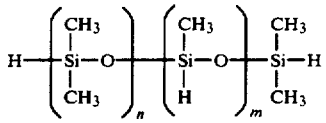

to form a γ-chlorofunctional silicone oil which may be converted to the desired aminofunctional oil by a reaction analogous to that described above for $X=CH_2$. Alternative methods are also well known to the person skilled in the art.

Compounds of the above-mentioned type of dispersing agents in which X stands for an aminoalkoxy group may be prepared by the reaction of silicon functional oils containing, for example, SiCl, $SiOCH_2H_5$,

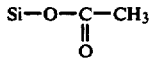

or SiH group with aminoalkanols, optionally with the addition of suitable catalysts. 1-Propanolamine has proved to be particularly suitable for this purpose. In aminoalkoxyfunctional systems, m may (advantageously) assume the value 0. One particularly preferred dispersing agent is an aminoalkoxyfunctional polysiloxane corresponding to the formula

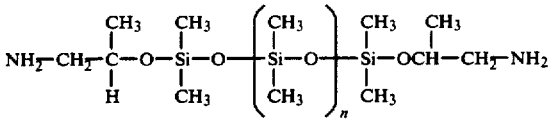

wherein n has a value of from 15 to 100, preferably from 30 to 70.

It is also possible first to prepare the silane,

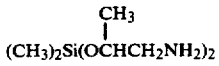

and this could be followed by chain-lengthening by a basic catalysed equilibrium reaction with the addition of octamethylcyclotetrasiloxane.

The EVFs prepared as described above were tested in a modified rotation viscosimeter as described by W. M. Winslow in J. Appl. Phys. 20 (1949), pages 1137–1140.

The surface area of the electrode of the inner rotating cylinder which has a diameter of 50 mm is about 78 $cm^2$ and the width of the gap between the electrodes is 0.58 mm. For dynamic measurements the shear load may be adjusted to a maximum of 2330 $s^{-1}$. The measuring range of the viscosimeter for the shear stress extends to a maximum of 750 Pa. Both static and dynamic measurements may be carried out. The EFV may be activated both by direct voltage and by alternating voltage.

Some liquids when activated by direct voltage may undergo not only a spontaneous increase in viscosity or attainment of the flow limit when the field is switched on but also slow deposition of the solid particles on the electrode surfaces. These are liable to falsify the measuring results, especially when the shear velocities are low or in static measurements. Testing of the EVF is therefore preferably carried out with alternating voltage and dynamic shear stress. The flow curves then obtained are accurately reproducible.

A constant shear velocity of $O<D<2330\ s^{-1}$ is adjusted for determining the electroreactivity, and the dependence of the shear stress $\tau$ on the electric field strength E is determined. The test apparatus are capable of producing alternating fields up to a maximum effective field strength of 2370 kV/m at a maximum effective current of 4 mA and a frequency of 50 Hz. Flow curves corresponding to those of FIG. 1 are obtained. It will be seen that at low field strengths, the shear stress $\tau$ initially varies in the form of parabola while at high field strengths it increases linearly. The slope S of the linear part of the curve may be seen from FIG. 1 and is given in Pa.m/kV. The threshold $E_O$ of the electric field strength is found at the point of intersection of the straight line $\tau=\tau_0$ (shear stress without electric field) and is given in kV/m. The increase in shear stress $\tau(E)-\tau_0$ in the electric field $E>E_0$ is expressed as $$\tau(E)-\tau_0=S\cdot(E-E_0).$$

The measurements may be repeated at different shear velocities D. The values found for $E_0$ and S are generally scattered within a range of about ±5% to ±20% about the mean value.

In the examples described below, the formulations characterized by the letter E are examples according to the invention and the other examples are to be regarded as state of the art (basis for comparison).

Formulations 1 to 14 demonstrate the influence of the atomic ratio Al/Si on the surface of the different disperse phases. Formulations 15, 16, 18, 20, 21, 23 and 24 show that the advantageous effect of the aluminum silicates according to the invention is also obtained with other dispersing agents. Examples 20, 21 and 25 show that this also applies to other dispersion media.

Examples 6, 7, 9, 10, 16, 21 and 25 illustrate the the EVFs according to the invention are also effective at elevated temperatures. The advantageous effect at elevated temperatures of EVFs containing polysiloxane based dispersing agents (Examples 7 and 25 by comparison with Examples 15 and 20) should be particularly noted.

EXAMPLARY EMBODIMENTS

| | |
|---|---|
| Silicone oil 1: Polydimethylsiloxane | |
| Viscosity at 25° C.: | 5 $mm^2\ s^{-1}$ |
| Density at 25° C.: | 0.9 $g \cdot cm^{-3}$ |
| Dielectric constant $\epsilon r$ according to DIN 53483 at 0° C. and 50 Hz: | 2.8 |
| Silicone oil 2: Polymethylphenylsiloxane | |
| Viscosity at 25° C.: | 4 $mm^2\ s^{-1}$ |
| Density at 25° C.: | 0.9 $g \cdot cm^{-3}$ |
| Dielectric constant $\epsilon r$ at 25° C.: | about 2.5 |
| Isododecane | |
| Viscosity at 25° C.: | 1.7 $mm^2\ s^{-1}$ |
| Density at 25° C.: | 0.75 $g \cdot cm^{-3}$ |
| Dielectric constant $\epsilon r$ at 20° C.: | 2.1 |

Dispersing agent 1:

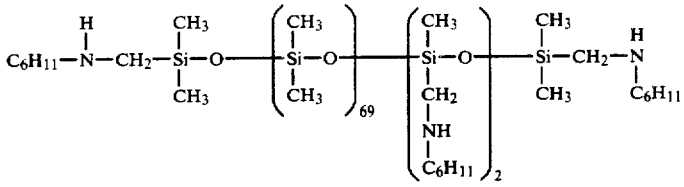

Dispersing agent 2: Sorbitan sesquioleate

Dispersing agent 3: Tetradecylamine

Dispersing agent 4: 2-Heptadecenyl-4,4(5H)—oxazole-dimethanol

Dispersing agent 5:

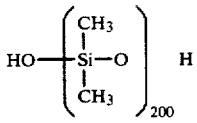

Dispersing agent 6:

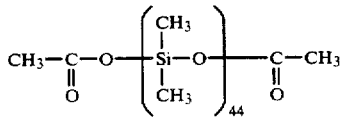

TABLE 2

| Dispersion phase | $SiO_2$ (% by wt.) | $Al_2O_3$ (% by wt.) | $Na_2O$ (% by wt.) | CaO (% by wt.) | Loss on annealing (1) (% by wt.) | Moisture (% by wt.) | Loss on annealing (2) (% by wt.) | Surface according to BET ($m^2/g$) |
|---|---|---|---|---|---|---|---|---|
| Silica gel 1 | 86 | <0.5 | <2.5 | — | | 6 | 13 | |
| Silica gel 2 | 80 | <0.4 | <3 | 6 | | 6 | 13 | 35 |
| Silicalith | 89 | <0.8 | | | 10 | | | |
| Al silicate 1 | 75 | 7 | 7 | — | | 6 | 13 | 65 |
| Al silicate 2 | 71 | 7.5 | 7.5 | — | | 6 | 13 | 115 |
| Al silicate 3 | 75 | 9 | 7 | — | | 6 | 13 | 90 |
| Al silicate 4 | 58 | 23 | 6 | | | 6 | 12 | |
| Erionite | 62 | 18 | 10 | | 10 | | | |
| Zeolite Y | 58 | 20 | 12 | | 10 | | | |
| Zeolite X | 43 | 29 | 18 | | 10 | | | |
| Zeolite A | 38 | 32 | 20 | | 10 | | | |
| China clay | 47 | 38 | | | | 5 | 13 | |
| $Al_2O_3$ | — | 99.5 | | | | 4 | | |

(1)3 hours at 500° C.
(2)according to DIN 55921

TABLE 2

| | Dispersion Phase | | Dispersion medium | | Dispersing agent | | | Electroviscous Properties | | | |
|---|---|---|---|---|---|---|---|---|---|---|---|
| | | | | | | | | 25° C. | | 90° C. | |
| No. | Type | Parts by wt. | Type | Parts by wt. | Type | Parts by wt. | Al/Si* | $E_O$ | S | $E_O$ | S |
| 1 | Silica gel 1 | 40 | Silicone oil 1 | 60 | Disp. agt. 1 | 6 | 0.00 | 792 | 206 | | |
| 2 | Silica gel 2 | 40 | Silicone oil 1 | 60 | Disp. agt. 1 | 2 | 0.00 | 574 | 389 | 433 | 608 |
| 3 | Silicalith | 50 | Silicone oil 1 | 50 | Disp. agt. 1 | 2.5 | 0.00 | 271 | 100 | | |
| 4 | Al silicate 1 | 40 | Silicone oil 1 | 60 | Disp. agt. 1 | 4 | 0.10 | 270 | 360 | | |
| 5 | Al silicate 2 | 40 | Silicone oil 1 | 60 | Disp. agt. 1 | 6 | 0.12 | 271 | 428 | | |
| 6E | Erionite | 50 | Silicone oil 1 | 50 | Disp. agt. 1 | 2.5 | 0.27 | 192 | 2104 | 241 | 1341 |
| 7E | Al silicate 3 | 40 | Silicone oil 1 | 60 | Disp. agt. 1 | 6 | 0.35 | 433 | 1039 | 428 | 836 |
| 8E | Al silicate 4 | 40 | Silicone oil 1 | 60 | Disp. agt. 1 | 8 | 0.42 | 380 | 1014 | | |
| 9E | Zeolite Y-$Na^+$ | 50 | Silicone oil 1 | 50 | Disp. agt. 1 | 2.5 | 0.45 | 229 | 1556 | 250 | 899 |
| 10E | Zeolite Y-$H^+$ | 60 | Silicone oil 1 | 40 | Disp. agt. 1 | 2.5 | 0.45 | 270 | 1077 | 323 | 943 |
| 11E | Zeolite X-$Na^+$ | 50 | Silicone oil 1 | 50 | Disp. agt. 1 | 2.5 | 0.71 | 693 | 959 | | |
| 12 | China clay | 60 | Silicone oil 1 | 40 | Disp. agt. 1 | 3 | 0.87 | 803 | 386 | | |
| 13 | Zeolite A-$Na^+$ | 50 | Silicone oil 1 | 50 | Disp. agt. 1 | 2.5 | 0.97 | 491 | 468 | | |
| 14 | $Al_2O_3$ | 54 | Silicone oil 1 | 46 | Disp. agt. 1 | 3 | — | 980 | 114 | | |
| 15E | Al silicate 3 | 40 | Silicone oil 1 | 60 | Disp. agt. 2 | 10 | 0.35 | 334 | 933 | 198 | 200 |
| 16E | Zeolite Y-$Na^+$ | 50 | Silicone oil 1 | 50 | Disp. agt. 2 | 2.5 | 0.45 | 291 | 1785 | 238 | 1095 |
| 17 | Silica gel 2 | 40 | Silicone oil 1 | 60 | Disp. agt. 2 | 4 | 0.00 | 780 | 470 | 232 | 273 |
| 18E | Al silicate 3 | 40 | Silicone oil 1 | 60 | Disp. agt. 3 | 8 | 0.35 | 293 | 1047 | | |
| 19 | Silica gel 2 | 40 | Silicone oil 1 | 60 | Disp. agt. 3 | 2 | 0.00 | 510 | 390 | | |
| 20E | Al silicate 3 | 50 | Isododecane | 50 | Disp. agt. 4 | 7.5 | 0.35 | 220 | 912 | 149 | 309 |
| 21E | Zeolite Y-$Na^+$ | 60 | Isododecane | 40 | Disp. agt. 4 | 6 | 0.45 | 151 | 1867 | 145 | 1043 |
| 22 | Silica gel 1 | 50 | Isododecane | 50 | Disp. agt. 4 | 3 | 0.00 | 459 | 244 | | |
| 23E | Al silicate 3 | 40 | Silicone oil 1 | 60 | Disp. agt. 5 | 6 | 0.35 | 326 | 1632 | | |
| 24E | Al silicate 3 | 40 | Silicone oil 1 | 60 | Disp. agt. 6 | 8 | 0.35 | 277 | 1621 | | |
| 25E | Al silicate 3 | 40 | Silicone oil 2 | 60 | Disp. agt. 1 | 6 | 0.35 | 375 | 991 | 364 | 937 |
| 26 | Silica gel 1 | 40 | Silicone oil 2 | 60 | Disp. agt. 1 | 4 | 0.00 | 650 | 173 | | |

*Surface atomic ratio
E = according to invention
without E = prior art

It will be understood that the specification and examples are illustrative but not limitative of the present invention and that other embodiments within the spirit and scope of the invention will suggest themselves to those skilled in the art.

What is claimed is:

1. An electroviscous fluid comprising more than 25% by weight of an aluminum silicate with a water content of 1 to 25% by weight as a disperse phase and an electrically non-conductive hydrophobic liquid as a liquid phase and a dispersing agent, wherein the atomic ratio Al/Si on the surface of the aluminum silicate lies in the range of 0.15 to 0.80.

2. An electroviscous fluid according to claim 1, comprising a non-functional silicone oil as a liquid phase, wherein the dispersing agent consists of aminofunctional or hydroxyfunctional or acetoxyfunctional or alkoxyfunctional polysiloxanes having a molecular weight above 800.

3. An electroviscous fluid according to claim 2, wherein the functional polysiloxanes are added at a concentration of 1 to 30% by weight, based on the aluminum silicate particles.

4. An electroviscous fluid according to claim 2, wherein the aminofunctional polysiloxanes having the following structure:

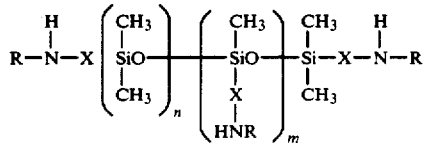

wherein $10<n<1000$, $m=0$ to 5,

R=H or alkyl with 1 to 8 atoms and X denotes a divalent hydrocarbon radical consisting of C, H and optionally O and/or N.

5. An electroviscous fluid according to claim 2, wherein the aminofunctional polysiloxanes have the following structure:

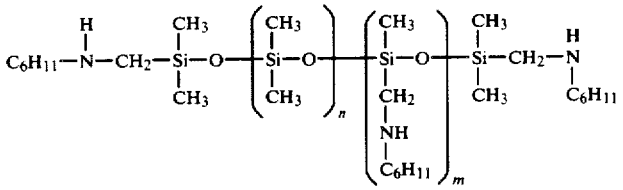

wherein $10<n<1000$ and $m=0$ to 3.

6. An electroviscious fluid according to claim 2, wherein the functional polysiloxanes have the following structure:

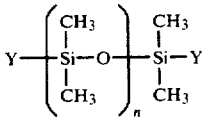

wherein $10<n<1000$ and y is a hydrolyzable group, more especially a hydroxy, alkoxy or carboxy group.

7. An electroviscous fluid according to claim 2, wherein the functional polysiloxanes are added at concentration of 5 to 20% by weight based on the aluminum silicate particles.

* * * * *

UNITED STATES PATENT AND TRADEMARK OFFICE

CERTIFICATE OF CORRECTION

PATENT NO. : 4,702,855

DATED : October 27, 1987

INVENTOR(S) : John Goossens, et al.

It is certified that error appears in the above-identified patent and that said Letters Patent is hereby corrected as shown below:

| | |
|---|---|
| Col. 3, line 46 | Delete "phase" and substitute --phases-- |
| Col. 4, line 9 | Correct spelling of --quantity-- |
| Col. 4, line 44 | Delete "olefins" and substitute --olefines-- |
| Col. 6, line 23 | Delete "group" and substitute --groups-- |
| Col. 6, line 59 | Delete "EFV" and substitute --EVF-- |
| Col. 8, line 16 | Delete "the" first instance and substitute --that-- |
| Col. 8, line 23 | Correct spelling of --EXEMPLARY-- |
| Col. 8, line 2 under "Isododecane" | Delete "Density at 25°C.:" and substitute --Density at 20°C.:-- |
| Col. 9-10, Table 2, 7th column heading | After "Moisture" insert --(2)-- |
| Col. 9-10, Table 2, 9th column | First line under "Surface according to BET ($m^2/g$)" insert --60-- |

Signed and Sealed this

Fourteenth Day of June, 1988

*Attest:*

*Attesting Officer*

DONALD J. QUIGG

*Commissioner of Patents and Trademarks*